US005517720A

United States Patent [19]

Anderson et al.

[11] Patent Number: 5,517,720

[45] Date of Patent: May 21, 1996

[54] CUSHION DEVICE FOR DOOR CLOSER ASSEMBLY

[75] Inventors: Thomas A. Anderson, Wyanet; George S. Nimee, Cherry; Jon C. Nye, Tiskilwa, all of Ill.

[73] Assignee: Schlage Lock Company, San Francisco, Calif.

[21] Appl. No.: 421,341

[22] Filed: Apr. 13, 1995

[51] Int. Cl.[6] ..... E05F 5/06; E05F 5/04

[52] U.S. Cl. ..... 16/85; 16/80; 16/82; 16/83

[58] Field of Search ..... 16/85, 80, 82, 16/83, 71, DIG. 21; 292/DIG. 19, DIG. 17

[56] References Cited

U.S. PATENT DOCUMENTS

| | | | |
|---|---|---|---|
| 2,587,287 | 2/1952 | Chamberlain | 16/85 |
| 3,683,450 | 8/1972 | Morrison et al. | 16/49 |
| 4,091,502 | 5/1978 | Little | 16/190 |
| 4,113,071 | 9/1978 | Muller | 16/82 |

*Primary Examiner*—M. Rachuba
*Assistant Examiner*—Adesh Bhargava
*Attorney, Agent, or Firm*—Keith F. Noe; Robert F. Palermo

[57] ABSTRACT

A door closer assembly provides a closing force to a door swingably mounted on a door jamb by a pair of arms pivotally attached to the door and the door frame. The door closer assembly has a housing and a spring for providing a closing force on the arm which closes the door when it is an open position. The improvement of the present invention includes a spring cushion device mounted on the housing of the door closer assembly for stopping the opening movement of the door as it reaches a predetermined angle of rotation. The cushion device provides a resilient counteracting force on the arm as the door reaches its predetermined angle of rotation which lessens the wear and tear exerted on the assembly by the opening force of the door.

9 Claims, 4 Drawing Sheets

CUSHION DEVICE FOR DOOR CLOSER ASSEMBLY

BACKGROUND OF THE INVENTION

This invention relates generally to mechanisms used to close doors and more particularly to a door closer assembly having a spring cushion device for stopping the opening movement of the door as it reaches a predetermined angle of rotation.

There are presently door closer assemblies which are capable of closing doors which are swingably mounted on a door jamb. Such assemblies include a housing mounted on either the door or the door frame and an arm or a pair of arms which interconnect the housing with the other of the door or the door frame. The housing includes a mechanism (e.g., a spring) which applies a closing force on the arm(s) for closing the door when it is in an open position.

Although such a door closer assembly may be constructed with mechanical stoppers for limiting the opening movement of the door when it reaches a predetermined angle of rotation, such a mechanical stopper exerts a great amount of force on the housing and the mechanism of the assembly which causes a great amount of wear and tear thereon. The purpose of providing the door closer assembly with the mechanical stopper is to prevent the door from being opened into a wall which is adjacent the door when it is in its fully open position. More specifically, when the door reaches its predetermined angle of rotation, the sudden impact of the mechanical stopper on the arm of the assembly which counteracts the opening force and the weight of the door can damage the door assembly. There is presently a need for a door closer assembly having means for cushioning the impact of the door against the mechanical stopper when the door reaches its predetermined open position.

The foregoing illustrates limitations known to exist in present door closer assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a door closer assembly which provides a closing force to a door swingably mounted on a door frame by at least one arm pivotally attached to the door and the door frame. The door closer assembly is mounted on one of the door and door frame (e.g., the door frame) and has a housing, means mounting the housing on the door frame, and means for providing a closing force on the arm which closes the door when it is an open position. The improvement of the present invention comprises a cushion device mounted on the housing of the door closer assembly for stopping the opening movement of the door as it reaches a predetermined angle of rotation. The cushion device provides a resilient, counteracting force on the arm as the door reaches its predetermined angle of rotation. The cushion device includes a contact block having an engaging surface for engaging the arm and means attaching the contact block to the housing of the door closer assembly. The attaching means comprises means for providing a resilient counteracting force on the contact block as the arm is moved laterally towards the contact block when the door reaches its predetermined angle of rotation.

More particularly, the contact block has a bore formed therein and the housing has a threaded bore formed therein coaxial with the bore of the contact block. The attaching means comprises a bolt fastener which is received in the bore of the contact block. The bolt fastener has a threaded end portion with external, male threads which threadably engages the threaded bore of the housing for attaching the contact block to the housing of the door closer assembly. The bolt fastener further has a shaft portion and a head portion. The resilient force means comprises a helical spring disposed within the bore of the contact block. The spring receives the shaft portion of the bolt fastener therethrough, engages the head portion of the bolt fastener, and is compressed by the head portion for providing the resilient counteracting force on the contact block as the arm is moved laterally towards the contact block when the door approaches its predetermined angle of rotation. The spring dampens the opening force of the door until the spring is fully compressed and the door ceases its opening movement.

The resilient force means is selectively adjustable for increasing and decreasing the resilient counteracting force applied to the arm for cushioning the arm as it approaches its predetermined angle of rotation. The bolt fastener is axially movable by threadably tightening and loosening the bolt fastener for increasing and decreasing the counteracting force of the spring, respectively. The bore of the contact block has a shoulder portion engagable with the head portion of the bolt fastener for limiting the movement of the bolt fastener when tightening the bolt fastener to a maximum counteracting force.

Accordingly, among the several objects of the present invention are the provision of a door closer assembly having a spring cushion device which provides a cushioning, counteracting force for dampening the impact of the opening force on the door to alleviate wear and tear on the door closer assembly; the provision of such a spring cushion device which is adjustable for increasing or decreasing the counteracting force; the provision of such a spring cushion device which may be retrofitted on existing doors; the provision of such a spring cushion device which may be mounted on the assemble for either left-handed or right-handed door arrangements; and the provision of such a spring cushion device which is simple in design, cost-efficient to manufacture, and easy to assemble.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
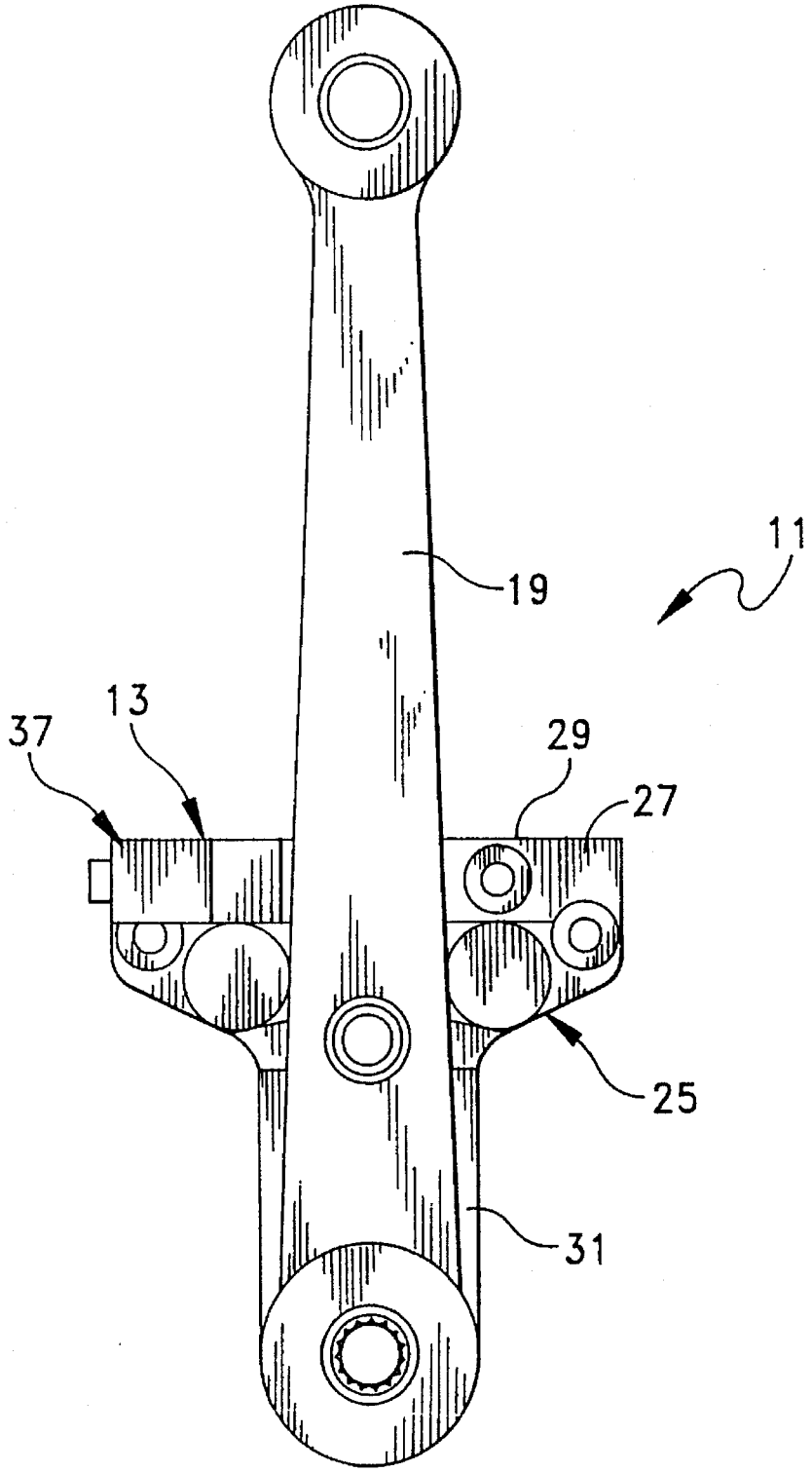
FIG. 1 is a bottom plan view of a door closer assembly having a spring cushion device of the present invention, the door closer assembly being provided for closing a door swingably attached to a door frame.

Referring now to the drawings, wherein similar reference characters designate corresponding parts throughout the several views, there is generally indicated at 11 a door closer assembly having a spring cushion device, generally indicated at 13, for dampening and stopping the opening movement of a door 15 which is pivotally attached by a plurality of hinges (not shown) to a door jamb in a conventional fashion. Such assemblies as the type illustrated in the drawings provide a closing force on the door 15 when it is in an open position and may also be adapted for stopping the opening movement of the door 15 upon reaching a predetermined angle of rotation. The ability of the door closer assembly 11 to stop the opening movement of the door 15 may be desirable for preventing the door 15 from engaging and potentially damaging a wall (not shown), for example, which is in close proximity to the door when it is opened. As shown, the door closer assembly 11 is mounted on the top, horizontally disposed door frame 17. An arm 19 is pivotally attached at one of its ends to the housing 25 of the assembly 11 and at its other end (as by a hinge element, not designated) to another arm 21 which is pivotally attached by means of a suitable bracket 23 to the door 15. It should be understood that the door closer assembly 11 may alternatively be mounted on the door 15 instead of the door frame 17 and still fall within the scope of the present invention.

Figure 2:
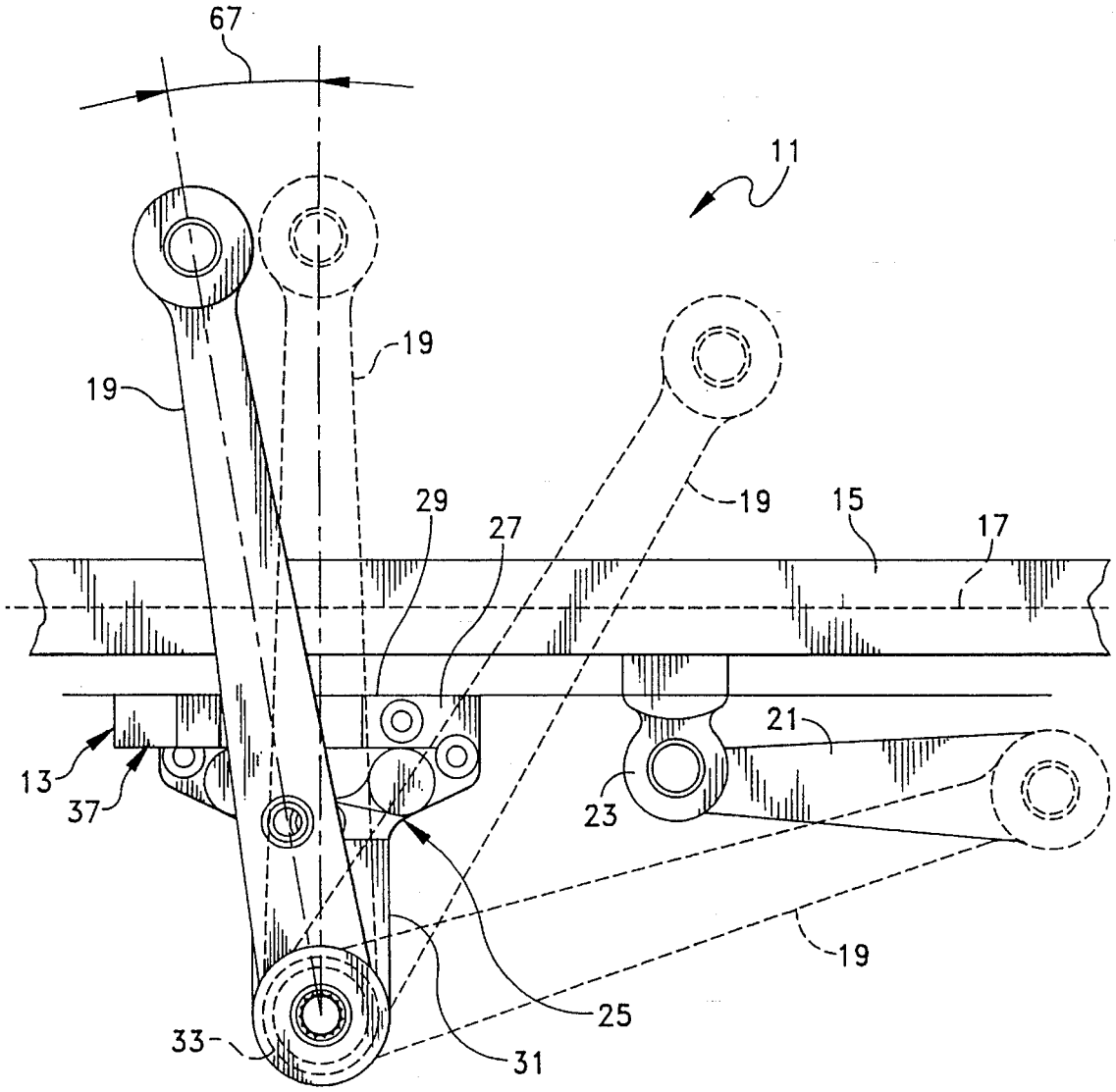
FIG. 2 is a bottom plan view similar to FIG. 1 illustrating the sequence of moving the door from a closed position to an open position.

The door closer assembly 11 includes a T-shaped housing, generally indicated at 25, which has a mounting section 27 with a planar surface 29 for mounting the housing 25 on the door frame 17 by screw fasteners (not shown) and an extended section 31 which is integral with the mounting section 27 and constructed for being pivotally attached to arm 19. The extended section 31 of the housing 25 includes a pivot point 33 for pivotally attaching arm 19 to the housing. A compression spring (not designated) provided within the housing 25 is interconnected between the assembly 11 and the arm 19 and applies a moment force on the arm 19 in the clockwise direction (as illustrated in FIG. 2) for closing the door 15. Preferably, the housing 25, along with the other component parts of the assembly 11, is fabricated from rigid metal, such as steel. This construction of the door closer assembly 11 is well-known in the art of door closer assemblies and the arrangement in FIGS. 1 and 2 may embody other constructions, such as by mounting the door closer assembly 11 on the door 15 as mentioned above.

Figure 3:
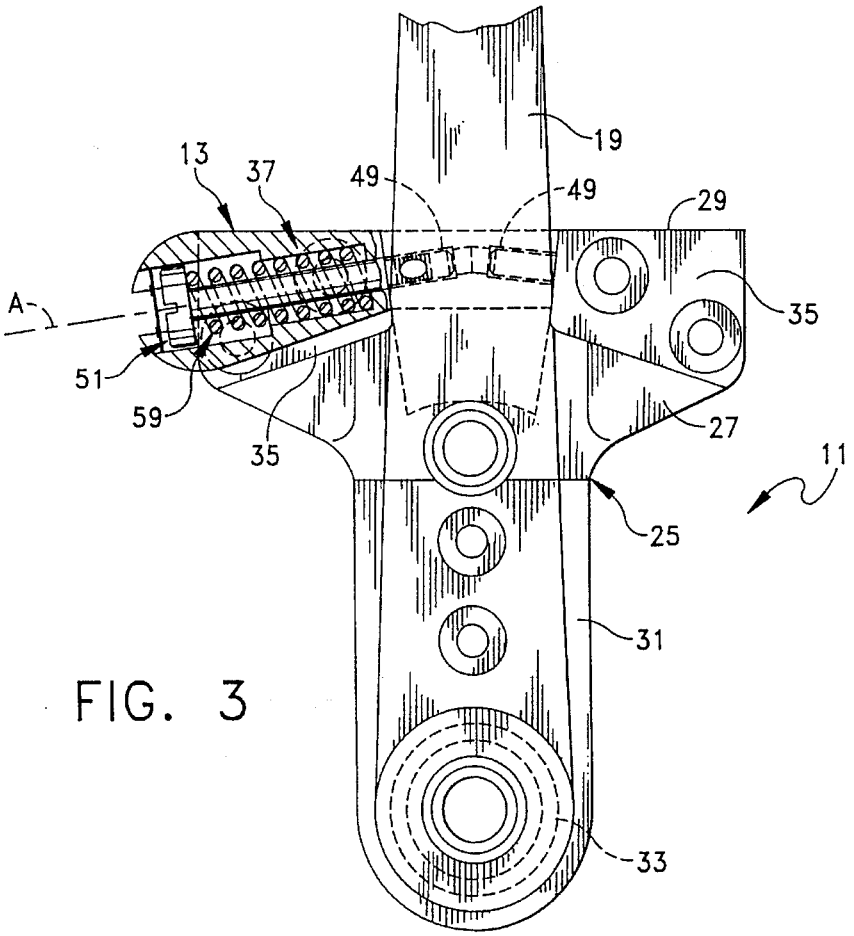
FIG. 3 is an enlarged bottom plan view with the spring cushion device being illustrated in cross section.
Figure 4:
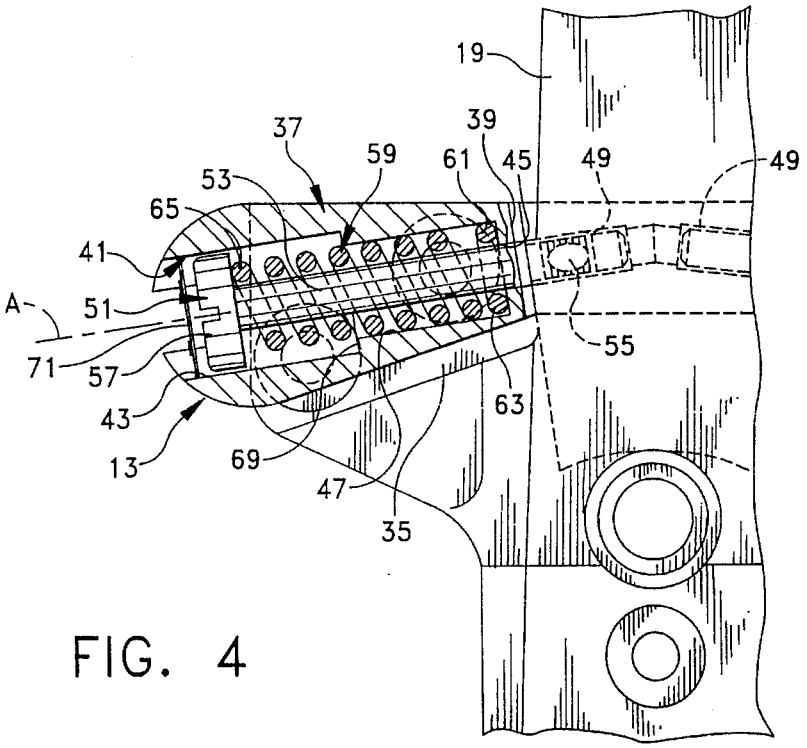
FIG. 4 is an even greater enlarged cross-sectional, bottom plan view of the spring cushion device.

The door closer assembly 11 of the present invention is designed for stopping the opening movement of the door 15 when the door 15 reaches a predetermined angle of rotation. More specifically, the spring cushion device 13 is mounted on the housing 25 within one of two cut-away areas 35 of the housing 25 (e.g., the left-hand side cut-away area 35) on the bottom surface of the housing as illustrated in FIGS. 3–6 for dampening and eventually stopping the opening movement of the door 15 as it reaches a predetermined angle of rotation. The provision of two cut-away areas 35 is for mounting the device 13 on the housing 25 to accommodate left or right-handed door arrangements. As illustrated in FIG. 3, the spring cushion device 13 is mounted on the housing 25 of the assembly 11 in a position in which it engages the arm 19 when the arm 19 extends along a vertical axis generally perpendicular to the direction of the door frame 17, and the door 15 is at an approximately ninety degree angle with respect to the direction of the door frame 17. As will be described below, the spring cushion device 13 is adjustable, for varying the cushioning force on the arm 19 when the door 15 reaches its predetermined angle of rotation. It should be understood that the housing 25 of the assembly 11 may be modified for changing the angle in which the spring cushion device 13 engages the arm 19 of the door 15. Such a modification could be achieved by mounting the door closer assembly 11 on the door frame 17 at a different location along the door frame 17.

Turning now to FIGS. 3–6, the spring cushion device 13 comprises a contact block, generally indicated at 37, which is received in the cut-out area 35 of the housing 25. As with the housing 25 and arms 19, 21 of the assembly 11, the contact block 37 is preferably fabricated from steel. The contact block 37 is shaped for being received in the area 35 and includes a shoulder which defines an engaging surface 39 for engaging a narrow edge of the arm 19 when the door 15 reaches its predetermined angle of rotation. A bore, generally indicated at 41, is formed in the contact block 37, the bore 41 having an increased diameter portion 43, a reduced diameter portion 45, and an intermediate diameter portion 47 having a diameter less than the increased diameter portion 43 and greater than the reduced diameter portion 45. A threaded bore 49 with internal female threads (not designated) is formed in the housing 25. As shown, another threaded bore 49 is provided for mounting the contact block 37 on the right-hand side of the assembly 11. Each bore 49 is coaxial with the bore 41 of the contact block 37 along an axis A when the contact block 37 is placed within the area 35 of the housing 25.

Means embodying a bolt fastener, generally indicated at 51, releasably and adjustably attaches the contact block 37 to the housing 25. The bolt fastener 51 includes a shaft portion 53 with a reduced diameter threaded end portion 55, and a head portion 57 which can be turned by a screwdriver (or by some other device such as a hex head wrench). The threaded end portion 55 of the bolt fastener 51 has external, male threads (not designated) which are threadably received by the left-hand threaded bore 49 of the housing 25 for mounting the contact block 37 thereto.

The spring cushion device 13 further includes means embodying a helical spring, generally indicated at 59, for providing a resilient counteracting force on the contact block 37 as the arm 19 is moved laterally towards the contact block 37 when the door 15 reaches its predetermined angle of rotation. As shown, the spring 59 receives the shaft portion 53 of the bolt fastener 51 therethrough and is disposed within the bore 41 in the increased diameter portion 43 and intermediate diameter portion 47. An end 61 of the spring 59 engages a first shoulder 63 located at the junction of the intermediate diameter portion 47 and the reduced diameter portion 45 of the bore 41 (see FIGS. 4 and 5). An opposite end 65 of the spring 59 engages the head portion 57 of the bolt fastener 51 for providing the resilient counteracting force on the arm 19 via the contact block 37 as the arm 19 is moved towards the contact block 37 when the door 15 approaches its predetermined angle of rotation. Thus, when the door 15 first engages the contact block 37 (see FIG. 5), the force of the arm 19 on the contact block 37 compresses the spring 59 as the door 15 and arm 19 continues their opening movement (see FIG. 6). The spring 59 provides a counteracting dampening force on the arm 19 so that the door 15 does not immediately stop, but stops slowly along an angle of rotation shown 67 shown in FIG. 2. At the point where the spring 59 is fully compressed, the contact block 37 is moved to its outermost position and the door 15 is then fully opened (see FIG. 6). This fully opened position is short of the obstacle (e.g., the wall) which is to be protected.

Figure 5:
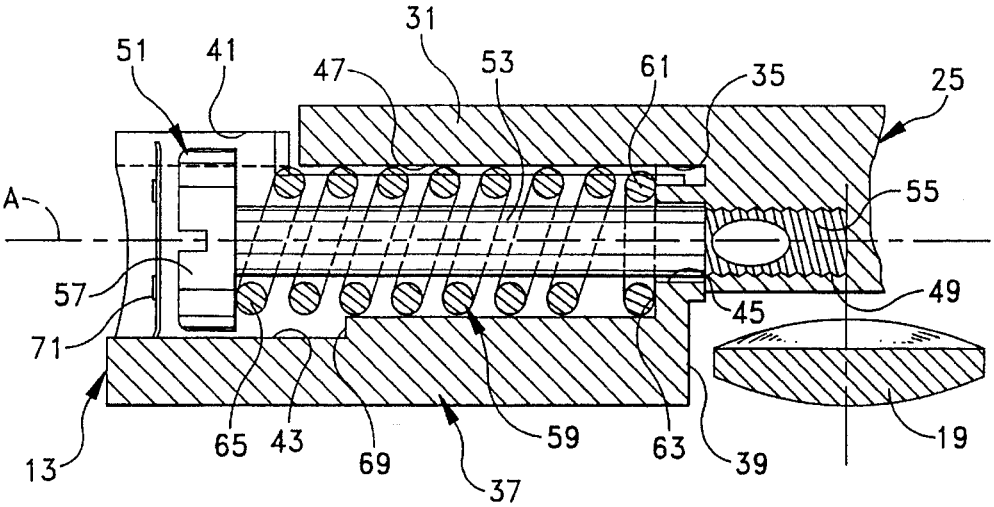
FIG. 5 is a cross-sectional, elevational view of the spring cushion device with an arm of the assembly being in adjacent but spaced relationship from the device.
Figure 6:
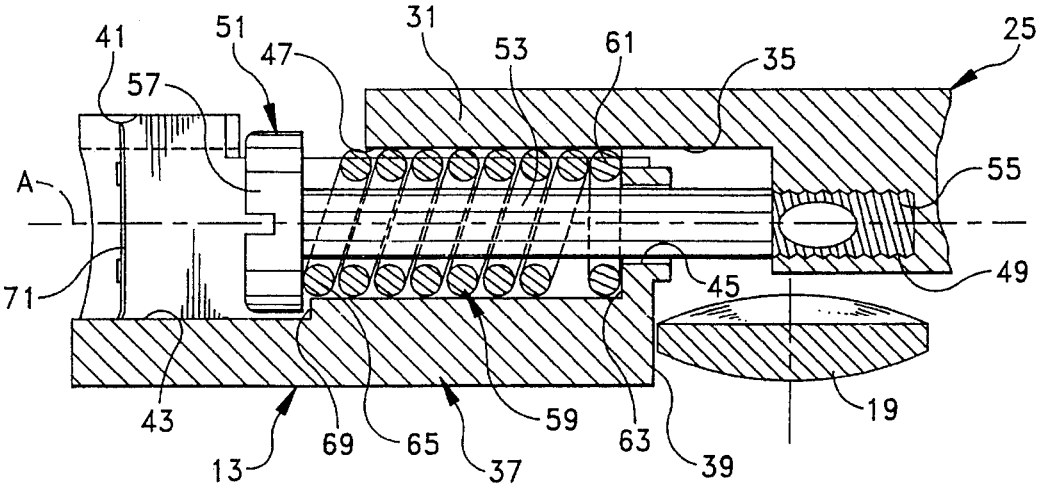
FIG. 6 is a cross-sectional, elevational view similar to FIG. 5 illustrating the arm engaging the spring cushion device.

The bolt fastener 51 is axially movable along axis A by threadably tightening and loosening the bolt 51 for increasing and decreasing, respectively, the resilient counteracting force of the spring 59. More specifically, when the threaded end portion 55 of the bolt fastener 51 is fully threadably engaged with the threaded bore 49 of the housing 25, the spring 59 is more compressed thereby increasing the resilient counteracting force. Conversely, when the threaded end portion 55 of the bolt fastener 51 is less than fully engaged with the threaded bore 49 of the housing 25, the spring 59 is less compressed thereby increasing the closing distance and angle which is indicated by reference number 67 in FIG. 2. This increases the length of movement of the contact block 37 when engaged by the arm 19 of the assembly 11 and thus effectively decreases the resilient counteracting force. As shown in FIGS. 5 and 6, there is indicated at 69 a second shoulder portion at the junction of the increased and intermediate diameter portions 43, 47 of the bore 41. The second shoulder 69 engages the head portion 57 of the bolt fastener 51 for limiting the axial movement of the bolt fastener 51 when tightening the bolt fastener to a maximum resilient counteracting force. This second shoulder 69 prevents over-compression of the spring 59 so that it is capable of producing a counteracting force.

The spring cushion device 13 also includes an end cap 71 which is sized for being inserted into the bore 41 of the contact block 37. The end cap 71, when inserted in the bore 41 in a position where it closes the open end of the bore 41 and covers the head portion 57 of the bolt fastener 51, maintains the bolt fastener 51 and spring 59 in assembled relation with the contact block 37. More specifically, the end cap 71 prevents the axial movement of the bolt fastener 51 and the spring 59 out of the bore 41. Preferably, the end cap 71 has a tight, interference fit with the contact block 37 when it is inserted in the bore 41 so that it retains the bolt fastener 51 within the bore 41 during shipping, or should excessive force of the arm 19 cause the bolt fastener 51 to break. The end cap 71 is preferably designed to be permanently installed within the bore 41 of the contact block 37 so that it is resistant to tampering.

FIGS. 5 and 6 illustrate the operation of the spring cushion device 13 of the door closer assembly 11. FIG. 5 illustrates the arm 19 in a position where it is adjacent but spaced from the engaging surface 39 of the contact block 37. In this position, the door 15 is approaching its predetermined angle of rotation. Upon engaging the engaging surface 39 of the contact block 37, the arm 19 forces the contact block 37 laterally outwardly. The spring 59 housed within the bore 41 of the contact block 37 provides a resilient counteracting force on the contact block 37 for dampening the opening force caused by the arm 19 and door 15. FIG. 6 illustrates the spring 59 in a fully compressed position. This counteracting force, while not completely dampening the impact force of the arm 19 and door 15 on the door arm closer assembly 11 under all circumstances (e.g., when an excessive opening force is applied on the door 15), substantially prevents unwanted wear and tear on the assembly 11.

While this invention has been illustrated and described in accordance with a preferred embodiment, it is recognized that variations and changes may be made therein without departing from the invention as set forth in the following claims.

Having described the invention, what is claimed is:

1. In a door closer assembly which provides a closing force to a door swingably mounted on a door frame by at least one arm pivotally attached to the door and the door frame, said door closer assembly being mounted on one of said door and door frame and having a housing, means mounting the housing on one of said door and door frame, and means for providing a closing force on the arm which closes the door when it is in an open position, the improvement comprising a cushion device mounted on the housing of the door closer assembly for stopping the opening movement of the door as it reaches a predetermined angle of rotation, said cushion device providing a resilient counteracting force on said arm as the door reaches its predetermined angle of rotation, said cushion device including a contact block having an engaging surface for engaging said arm, and fastener means for attaching the contact block to the housing of the door closer assembly, said fastener means comprising spring means providing said resilient counteracting force on said contact block as the arm is moved laterally towards the contact block when said door reaches its predetermined angle of rotation.

2. A cushion device as set forth in claim 1, said contact block having a clearance bore formed therein and said housing having a threaded bore formed therein coaxial with the bore of the contact block, said fastener means comprising a bolt fastener which is received through the bore of the contact block, said bolt fastener having a threaded end portion which threadably engages the threaded portion of the bore of the housing for attaching the contact block to the housing.

3. A cushion device as set forth in claim 2, said bolt fastener further having a shaft portion and a head portion.

4. A cushion device as set forth in claim 3, said spring means comprising a helical spring disposed within said bore of the contact block, said spring receiving the shaft portion of the bolt fastener therethrough and engaging said head portion of the bolt fastener and being compressed by said head portion for providing said resilient counteracting force on said contact block as the arm is moved laterally towards the contact block when said door approaches its predetermined angle of rotation, said spring dampening the opening force of the door until the spring is fully compressed.

5. A cushion device as set forth in claim 4, said spring means being selectively adjustable for increasing and decreasing the resilient force applied to said arm for cushioning the arm as it approaches its predetermined angle of rotation.

6. A cushion device as set forth in claim 5, said bolt fastener being axially movable by threadably tightening and loosening the bolt fastener for increasing and decreasing the counteracting force of the spring, respectively.

7. A cushion device as set forth in claim 6, said bore of the contact block having a shoulder portion engagable with the head portion of the bolt fastener for limiting the movement of the bolt fastener when tightening said bolt fastener to a maximum counteracting force.

8. A cushion device as set forth in claim 4 further comprising an end cap for maintaining said bolt fastener and spring in assembled relation with said contact block, said end cap being inserted in the open end of said bore for closing the open end thereby preventing said bolt fastener and spring from axially moving out of the bore of the contact block.

9. A cushion device as set forth in claim 1, said device being mountable on the housing in one of two locations of the housing, one location being suitable for left-handed door arrangements and the other location being suitable for right-handed door arrangements.

* * * * *